US005507655A

United States Patent [19]

Goerlich

[11] Patent Number: 5,507,655

[45] Date of Patent: Apr. 16, 1996

[54] SHIELDED ELECTRICAL CONNECTOR PLUG

[76] Inventor: Rudolf Goerlich, Brauerei-Elsaesser-Strasse 1, 74177 Bad Friedrichshall, Germany

[21] Appl. No.: 233,410

[22] Filed: Apr. 26, 1994

[30] Foreign Application Priority Data

Apr. 27, 1993 [DE] Germany ..... 43 13 771.7

[51] Int. Cl.[6] ..... H01R 4/66

[52] U.S. Cl. ..... 439/108; 439/79; 439/608

[58] Field of Search ..... 439/95, 98, 108, 439/608, 79, 607

[56] References Cited

U.S. PATENT DOCUMENTS

| | | | |
|---|---|---|---|
| 4,836,791 | 6/1989 | Grabbe et al. | 439/95 X |
| 5,104,341 | 4/1992 | Gilissen et al. . | |
| 5,183,405 | 2/1993 | Elicker et al. . | |
| 5,197,893 | 3/1993 | Morlion et al. . | |
| 5,261,829 | 11/1993 | Fusselman et al. | 439/608 X |

FOREIGN PATENT DOCUMENTS

| | | |
|---|---|---|
| 0107288 | 3/1986 | European Pat. Off. . |
| 0475179 | 3/1992 | European Pat. Off. . |
| 3904461 | 9/1990 | Germany . |
| 9208700 | 2/1993 | Germany . |

*Primary Examiner*—Khiem Nguyen
*Attorney, Agent, or Firm*—W. G. Fasse; W. F. Fasse

[57] ABSTRACT

An electrical connector plug, especially for use on circuit boards and electronic device interfaces, includes a synthetic material plug body (2) having narrow slots (5) provided therein. The slots (5) surround contact chambers (3) provided in the plug body (2). Electrically conducting shielding elements (6) are inserted in the slots (5) and are interconnected in a conducting manner as necessary to provide a shielding potential cage around the conducting contacts. In this manner a substantially coaxial shielding is provided around each electrical conductor contact (4). The shielded connector plug has substantially the same overall dimensions and the same contact pin configuration as conventional connector plugs and it is not necessary to sacrifice any of the conductor pin contacts to provide shielding contacts. By appropriately selecting materials for the components of the connector plug, magnetic shielding effects and filter effects can be achieved in the connector plug.

24 Claims, 3 Drawing Sheets

SHIELDED ELECTRICAL CONNECTOR PLUG

FIELD OF THE INVENTION

The invention relates to an electrical connector plug, especially for use with circuit boards and electrical device interfaces, having contact chambers formed in a synthetic material plug body, with electrical contacts arranged in the contact chambers and shielding elements arranged in the plug body.

BACKGROUND INFORMATION

Known two-part connector plugs of the pin and spring contact type generally include a so-called fixed connector plug and a so-called free connector plug. The arrangement of the male pin contact plug or the female spring contact plug as either the fixed connector plug or the free connector plug can be freely chosen as desired. When such connector plugs are used for circuit boards, for example, the fixed connector plug usually makes a generally straight connection and the free connector plug makes an angled connection. When connector plugs are to be used on conductor cables, the specific orientation and configuration of the connector plugs is generally adapted to the particular requirements of the cable at hand.

The operating frequencies of modern electronic components and systems are becoming so high that typical prior art connector plugs are increasingly becoming bottlenecks in the transmission of electrical signals due to the insufficient electrical characteristics of the connector plugs. Furthermore, substantial mechanical demands are also placed on certain connector plugs that act as electrical-mechanical interfaces between various electronic subassemblies and bus systems. The prior art has not been able to provide electrical connectors that satisfactorily meet both the electrical and mechanical requirements.

As an example of the prior art, European Patent Document No. 0,475,179 discloses a spring contact connector having shielding strips inserted into the chambers instead of the spring contacts. However, such an arrangement in the prior art connector only achieves shielding of the contacts on two sides rather than all around the contacts, and furthermore leads to the loss or sacrifice of some contacts for the purpose of shielding.

German Patent Publication No. 3,904,461 discloses a connector plug having a plug body made of an electrically conducting material in which the conductor contacts are embedded in an insulated manner. The method of making or assembling such connector plugs is rather complicated and deviates from the previously typical methods of production. For these reasons, such a connector plug is not deemed to be suitable for general purpose applications.

It has been a trend in the field of use of such connector plugs that ever more individual contacts per connector plug unit are required. This demand of ever more contacts is based to a substantial degree on the goal of achieving the required electrical quality of the signal conducting contacts with as many adjacent ground contacts as possible. For this reason, very many relatively expensive, high quality contacts are used up for static applications.

OBJECTS OF THE INVENTION

In view of the above it is the aim of the invention to achieve the following objects singly or in combination:

- to provide an electrical connector plug in which the individual contact passages are substantially impedance-matched, in a high frequency manner, to the desired characteristic impedance;
- to provide such an electrical connector plug in which the individual contacts are completely capacitively and inductively decoupled from one another;
- to provide such an electrical connector plug in which the connector plug as a whole is shielded in a manner protected from external conducting contact;
- to provide such an electrical connector plug that is mechanically strong and robust, even for a relatively long connector plug block having many individual contacts;
- to provide a coaxially arranged potential cage as a shielding around each individual contact of such an electrical connector plug;
- to provide selected materials having magnetic properties for the shielding elements in such an electrical connector plug in order to reduce or shield the effects of magnetic fields and to achieve certain filter effects; and
- to provide such an electrical connector plug having a relatively simple construction requiring relatively simple assembly operations for both a straight connector, as well as an angled connector at any desired angle.

SUMMARY OF THE INVENTION

The above objects have been achieved in an electrical connector plug according to the invention, wherein contact chambers are formed in a synthetic material plug body and individual contact members are arranged in the contact chambers. Slits or slots are formed in the synthetic material plug body in directions extending lengthwise and crosswise within the plug body and between the respective contact chambers. Electrically conducting shielding elements are inserted in the narrow slits or slots. In the final completely assembled state, the individual shielding elements are conductingly interconnected so as to form an axially extending closed potential cage around each individual contact element. That is to say, the potential cage extending through the plug body forms a substantially coaxial shielding arrangement around each individual contact element of the connector plug. The coaxially arranged shielding elements can be adjusted or optimized to achieve any desired characteristic impedance, within certain limits.

In cases in which the characteristic impedance of the coaxial arrangement of the potential cage must be especially precisely maintained in the transition region between the pin contact block and the spring contact block, it is possible to adjust or match the spacing between the shielding elements and the pin contacts in the pin contact block so as to maintain the required dimensional ratio between the inner conductor and the outer conductor in the coaxial arrangement. For example, in a pin contact block having a contact grid or interspacing of 2.5 mm, a characteristic impedance of 50Ω, for example, can be achieved in that two respective shielding elements are inserted between respective adjacent contact pins at a proper distance away from the contact pins. Depending upon the specific embodiment and configuration of the contacts of a connector plug, it is possible to provide both square cornered potential cages, as well as round potential cages, for example, by inserting round tube-shaped shielding elements into corresponding round grooves or slots in the connector plug body.

Furthermore, additional effects can be achieved by freely selecting a proper material for the shielding elements. For example, by making the shielding elements of ferromagnetic materials, it is possible to reduce the effects of magnetic fields and it is further possible to achieve certain filter effects in the electrical connector plug.

Moreover, electronic subassemblies including sensitive circuits and circuit components often suffer considerable problems of electrostatic discharges due to high contact potentials. It can be dangerous when a discharge occurs via a shielding element, especially when the subassembly or component is not installed in the electronic system. For this reason, it is an advantage of the invention that the shielding elements can be insulated so as to be protected from external contact and therewith protected from electrostatic discharges. In this manner it is also ensured that electrostatic discharges are not conducted into the electronic subassembly through the shielding. According to a particular embodiment of the invention, the shielding cage or potential cage is completely embedded in the synthetic material plug body of the free connector plug. This embodiment fulfills the requirement that the plug is externally protected against contact and against undesirable discharges in all directions when it is not plugged-in to a mating connector plug.

The conductor legs of the free connector plug used for circuit boards are usually bent or angled at 90° relative to the plugging-in or connecting direction. For these angled conductor legs, it is especially difficult to provide a potential cage that extends continuously in an axial direction and is closed all around. To achieve this, the invention provides an angled member made out of a synthetic material, such as a plastic material. The angled member acts as a bending tool and simultaneously acts to guide and hold the shielding elements and the conductor legs in the desired manner and configuration.

With such an embodiment including an angled member, it is possible to easily connect a connector plug with a circuit board using a simple tool pressing against the synthetic material body of the connector plug by carrying out a simple pressing operation. This is true even if the shielding effects are not needed and the shielding elements can be omitted. Several variations of a practical embodiment of this special angled member exist. For example, it is possible to provide a single 90° bend in the angled member or to provide two 45° bends in the angled member. The exact alignment, configuration, and bending of the conductor legs is assured by means of interlocking elements or alignment elements provided between the synthetic material body and the angled member along the lengthwise and/or crosswise directions of the connector plug.

The invention provides several different embodiments by which the potential cage can be connected to the appropriate conductor paths of the circuit board. For example, additional shielding conductor pins can be provided to extend in a direction and configuration similar to the main contact pins, for example. Alternatively, one or more of the contact pins can be connected to the potential cage, whereby those contact pins provide the necessary contact from the potential cage to the circuit board.

According to a further embodiment, the potential cages of two mating plugs are connected to one another by laterally arranged contacts. In this manner it is possible to provide a shielding that is as closed and continuous as possible over the entire plug connection. With such a construction, for example in a cable plug, the shielding of the cable is connected to the shielding of the connector plug so as to be as closed and uniform as possible. Thus, the shielding effect is uniformly continued along the connector plug and across the junction point to the mating connector plug. The uniform contacting according to the invention is especially advantageous if the connector plugs are to be coupled and decoupled frequently.

The several embodiments according to the invention have the special advantage that they can be used with already existing and already standardized structural configurations of connector plugs without jeopardizing the exchangability or interconnectability of the plugs. Moreover, it is thereby possible to manufacture the connector plugs according to the invention in an economical manner using typical production methods and apparatus.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS

Figure 1:
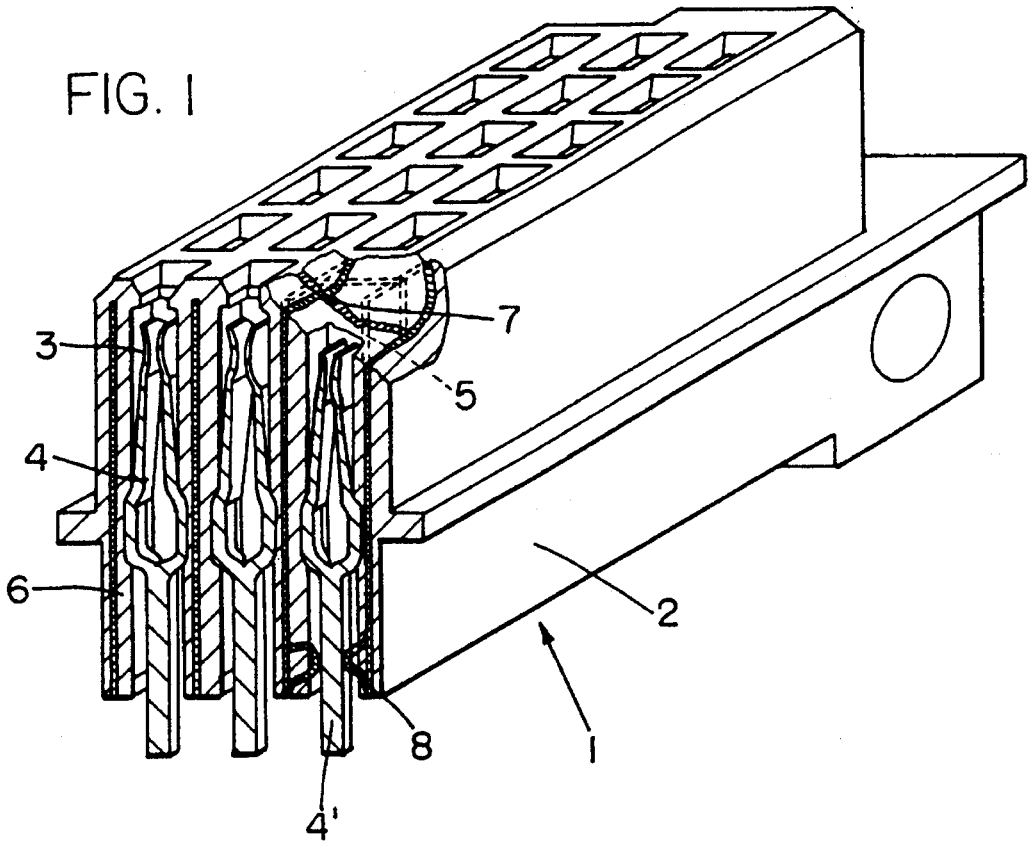
FIG. 1 is a perspective cross-section through a female spring contact block or plug according to the invention with a portion of the view broken open to show a specific detail.

FIG. 1 shows a spring contact block 1, which forms a female electrical connector plug. The spring contact block 1 includes a one-piece synthetic material body 2, for example a plastic body 2, with contact chambers 3 provided therein. A respective spring contact 4 is arranged in each of the contact chambers 3 in a manner insulated from the other spring contacts. As seen particularly in the broken view portion of FIG. 1, very thin slots or slits 5 are provided to extend lengthwise and crosswise in the synthetic material body 2 between the respective individual spring contacts 4, that is to say, between the respective contact chambers 3. The slots or slits 5 are provided to surround each spring contact 4. Shielding elements 6 are inserted lengthwise and crosswise into the slots 5. The respective shielding elements 6 contact one another in a conducting manner so that a single unitary potential cage 7 is formed to surround all of the spring contacts 4.

FIG. 1 shows a particular embodiment of providing a plug contact for the potential cage 7. Especially when after-equipping shielded connector plugs or replacing non-shielded plugs with shielded plugs, it is often not possible to provide additional contacts for the shielding. In such a case, one or more individual spring contacts 4' can serve as the shielding contact for the potential cage 7 in that contact tongues 8 are provided, which form a contact between the potential cage 7 and the spring contact 4'. The contact tongues 8 can be provided during the original manufacture of the connector plug or can be installed afterward.

Figure 2:
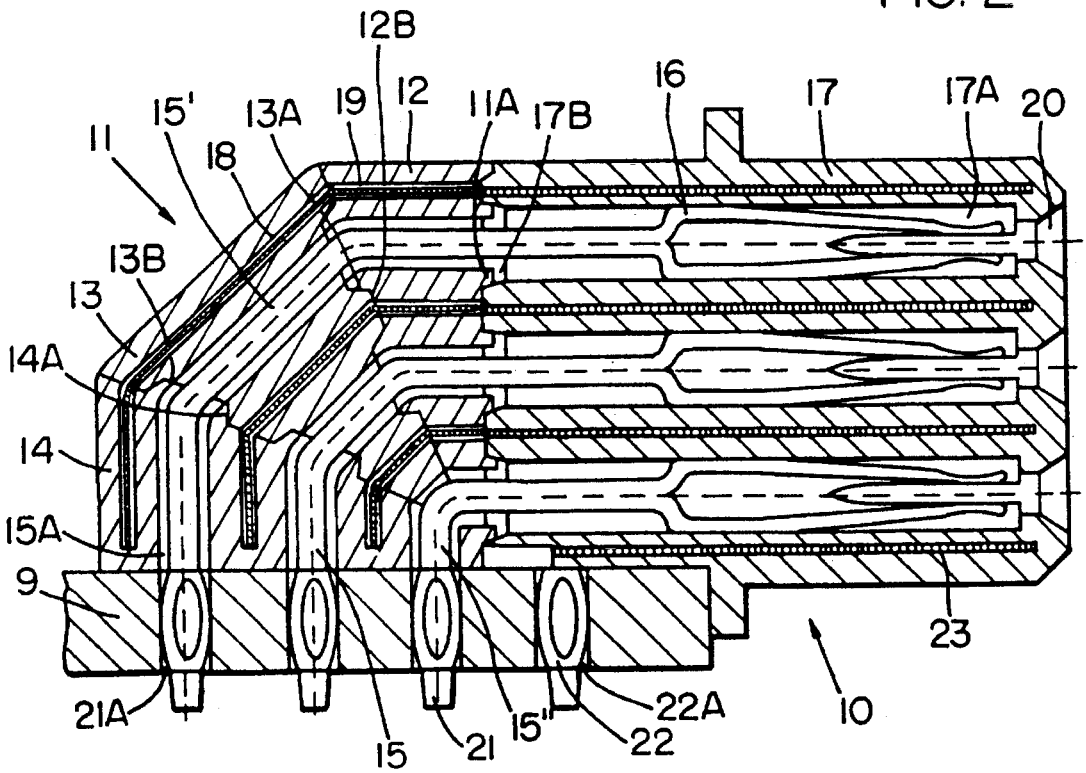
FIG. 2 is a cross-section through a second embodiment of a spring contact block according to the invention.

FIG. 2 shows an advantageous embodiment of a spring contact block 10 with an angled member 11 mounted on a circuit board 9, such as a printed circuit board. The angled member 11 comprises three substantially wedge-shaped sections 12, 13 and 14. Conductor legs 15 are connected to the spring contacts 16, which are arranged in holes or contact chambers 17A within the synthetic material block 17. The conductor legs 15 pass through corresponding channels or holes 15A provided in the angled member 11. The channels 15A thus form an extension portion of the chambers 17A.

With this arrangement, the full 90° bending of the conductor legs 15 is carried out as two 45° bends within the angled member 11. Specifically, a 45° bend exists in each conductor leg 15 at each junction between respective adjacent sections 12, 13 and 14 of the angled member 11. This embodiment is particularly advantageous because the provision of two 45° bends in the conductor legs 15 shortens or reduces the difference in length between the outermost conductor leg 15' and the innermost conductor leg 15", as compared to using a single 90° bend. This embodiment is more advantageous than a 90° bend embodiment especially for high frequency conducting applications.

The synthetic material plug body 17, as well as the sections 12, 13 and 14, have narrow slots 18 provided around the respective spring contacts 16 and conductor legs 15 in a manner similar to that described above with reference to the embodiment of FIG. 1. Shielding elements 19 are inserted in the narrow slots 18 and conductingly interconnected to form a potential cage 23 in a manner similar to that described above. The shielding for the spring contacts 16 is thus continuously provided without gaps from the plug-in or receptacle opening 20 all the way to the circuit board 9.

The individual sections 12, 13 and 14 of the angled member 11 are interconnected to each other by interlocking members such as dovetail ridges 14A and 13A that correspond and mate with dovetail grooves 13B and 12B, for example. Similarly, the angled member 11 is attached to the plug body 17 by interlocking ridges 11A and corresponding grooves 17B, for example. The interlocking members 12B, 13A, 13B and 14A properly align the sections 12, 13 and 14 to ensure that termination 21 provided on the ends of the conductor legs 15 are held in the proper angles. Additional termination 22 connects the circuit board 9 to the potential cage 23 formed of the shielding elements 19.

Because all of the conductor legs 15 are fixed or held relatively rigidly in the angled member 11, it is possible to insert or plug the connector pins 21 and 22 of the spring contact block 10 into corresponding holes 21A and 22A provided in the circuit board 9, simply by properly positioning the connector plug and pressing the synthetic material plug body 17 and the angled member 11 against the circuit board 9. When they are inserted into the corresponding holes 21A and 22A in the circuit board 9, the termination 21 and 22 make contact with circuits on the circuit board 9 in an essentially known manner.

Figure 3:
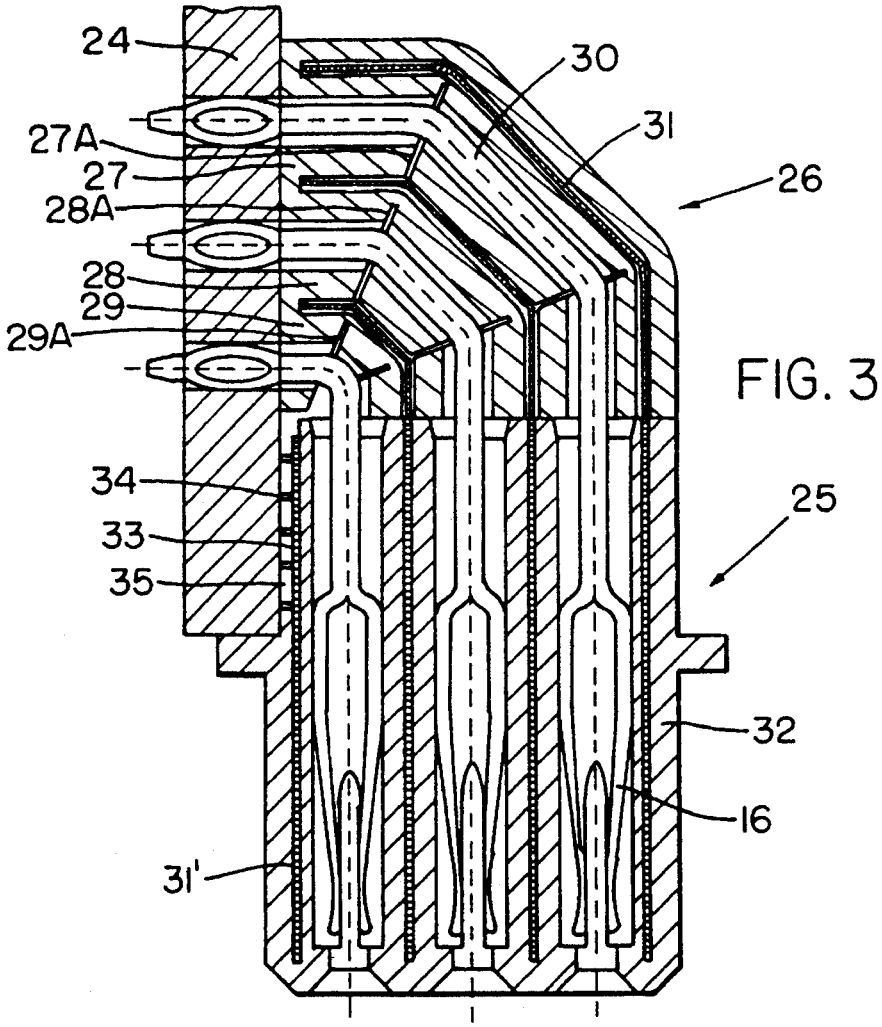
FIG. 3 is a cross-section through yet another embodiment of a spring contact block according to the invention.

FIG. 3 shows a further alternative embodiment of a spring contact block 25 with an angled member 26 mounted on a circuit board 24. The angled member 26 comprises three separate segments 27, 28 and 29 that each extend lengthwise along the corresponding conductor legs 30. That is to say, while the sections 12, 13 and 14 of FIG. 2 are arranged circumferentially next to one another about the axis of the bend, the segments 27, 28 and 29 of the angled member 26 of FIG. 3 are arranged substantially radially or coaxially next to one another relative to the axis of the bend. Thus, each segment 27, 28 and 29 receives or encloses a respective row of conductor legs 30.

To form the connector plug of FIG. 3, conductor legs 30 and shielding elements 31 are arranged in the synthetic material plug body 32 and initially extend substantially straight from the end of the plug body 32. The segments 27, 28 and 29 are initially substantially straight and are pushed onto the substantially straight conductor legs 30 and shielding elements 31. Then, each segment 27, 28 and 29 is bent to the side by 45° along each of two bending grooves 27A, 28A and 29A provided in each of the segments 27, 28 and 29. Then, the angled member 26 can be coupled or interlocked with the plug body 32, for example, in the manner described with reference to FIG. 2.

FIG. 3 further shows an advantageous embodiment of a flat surfacial contact portion 33 of the shielding element 31'. This embodiment does not require any additional holes to be bored into the circuit board 24 in order to make a contact to the shielding cage. In fact, this embodiment makes the necessary contact in an otherwise unused dead space on the circuit board 24. On the contact portion 33, a plurality of contact points 34 are provided on the shielding element 31' in a slightly springy or elastically yielding manner. The contact points 34 make contact with the corresponding conductor path 35 on the circuit board 24 in a reliable and durable manner along the entire length of the connector plug. This arrangement is particularly advantageous for an effective shielding of high frequency signals.

Figure 4:
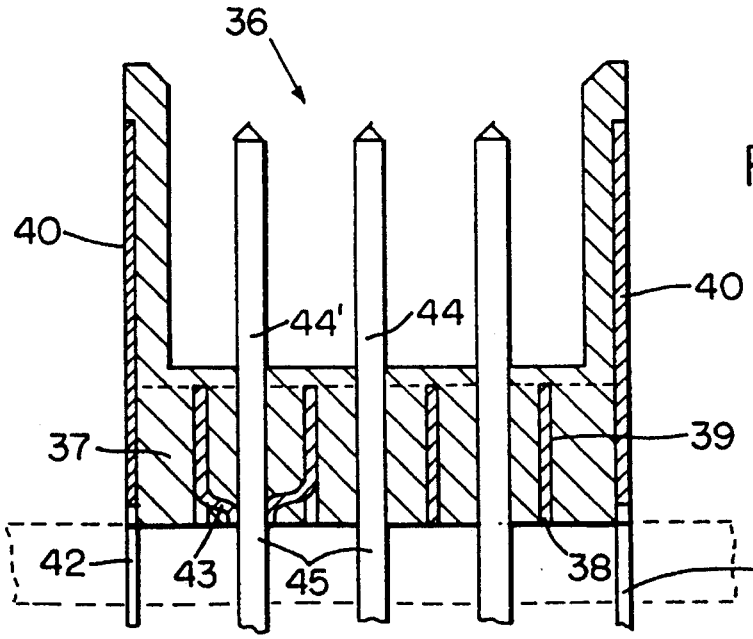
FIG. 4 is a cross-section through a male pin contact block according to the invention which may, for example, mate with the spring contact block shown in FIG. 3.

FIG. 4 shows a shielded pin contact block 36 comprising a synthetic material plug body 37 having narrow slots 39 provided therein, in which shielding elements 38 are inserted. A respective metal plate 40 is provided in each of the two lengthwise sides of the pin contact block 36. The metal plates 40 are rigidly attached to the pin contact block 36 and are, for example, preferably formed or injection molded into the pin contact block 36. The two metal plates 40 are connected in a conducting manner with the crosswise extending shielding elements 38.

The metal plates 40 complete the shielding cage together with the shielding elements 38, but also provide a desired mechanical strengthening and stiffening of the pin contact block 36. Especially modern connector plugs that are quite long and have a high pin count require quite high plug-in insertion forces. A simple connector plug without any additional strengthening or stiffening measures cannot withstand these high plug-in forces.

The metal plates 40 are provided with terminations which are similarly shaped and generally correspond to the terminations 45 of the pin contacts 44. This configuration of the terminations 41 on the one hand conducts the shielding potential to the circuit board 42 at an optimum spacing and on the other hand also provides strengthening for the circuit board 42. Alternatively, contact tongues 43 can be provided to make a contact between the shielding elements 38 and at least one of the pin contacts 44' which further makes contact with the circuit board 42.

Figure 5:
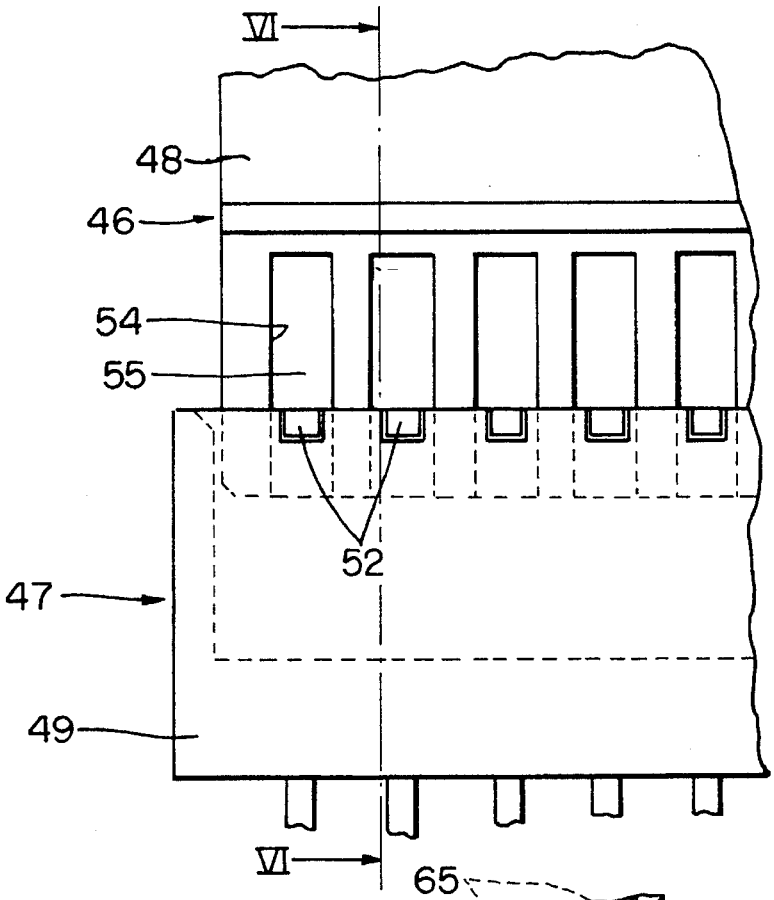
FIG. 5 is a partial schematic side view of a pin contact block and a spring contact block being coupled together.
Figure 6:
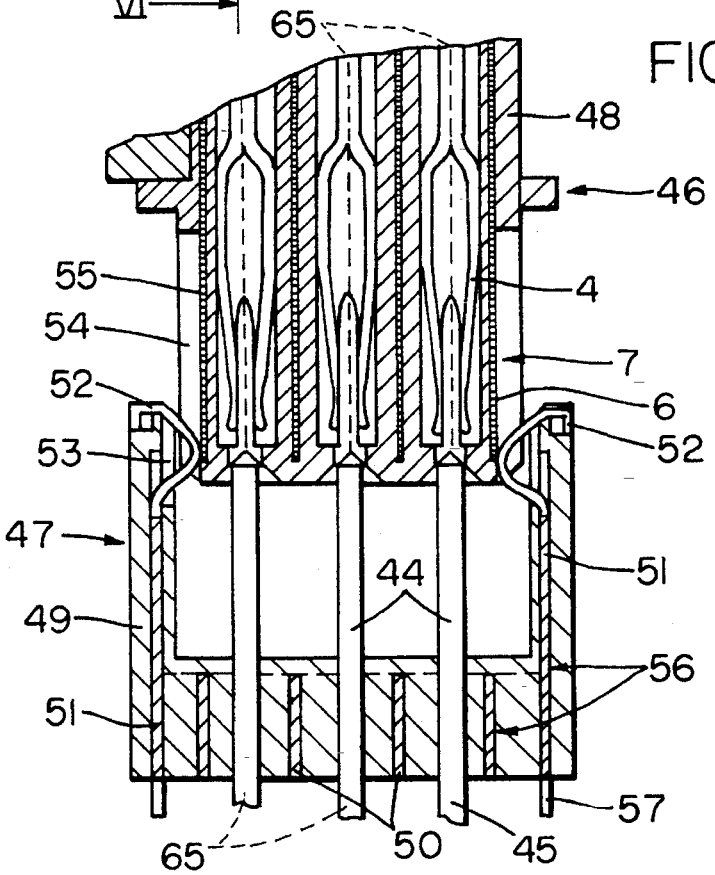
FIG. 6 is a cross-section through the embodiment shown in FIG. 5 taken along the line VI—VI of FIG. 5.

FIGS. 5 and 6 show a further embodiment of the invention and particularly show a mating pin contact block 46 and spring contact block 47 in a configuration as the two connector plugs are being plugged together. The pin connector block 46 comprises a synthetic material plug body 48 in which individual spring contacts 4 are arranged so as to be shielded by shielding elements 6 that together form a potential cage 7. In this arrangement the shielding elements 6 extend or project beyond the spring contacts 4 when considered in a plug-in direction. The pin contact block 47 comprises a synthetic material plug body 49 in which pin contacts 44 are arranged and surrounded or shielded by a potential cage 56 formed of shielding elements 50. The arrangement of various components in this embodiment is generally similar to the embodiments described above, except for the distinctions described with reference to FIGS. 5 and 6.

Sheet metal strips 51 are connected to the potential cage 56 in a conducting manner. The metal strips 51 are embedded in the outer side walls of the synthetic material plug body 49. Thus, the metal strips 51 extend along the lateral sides of the pin contact block 47. Each metal strip 51 comprises a row of separate contact elements 52 along its upper edge. Each of the contact elements 52 is arranged in a corresponding slot 53 provided in the synthetic material plug body 49 so as to protrude inwardly from the wall of the plug body 49. A row of individual terminations 57 are provided along the bottom edge of each metal strip 51, wherein the contacts or terminations 57 substantially correspond to the terminations 45 of the pin contacts 44.

In the spring contact block 46, slots 54 are formed in the outside walls of the synthetic material plug body 48. The lateral position and spacing of the slots 54 corresponds to that of the contact elements 52 of the pin contact block 47. The slots 54 expose an outermost shielding element 55 arranged in the plug body 48. The shielding element 55 can also be an inserted sheet metal strip that extends over the entire lateral side of the spring contact block 46.

When the two connector plugs 46 and 47 are coupled or plugged in to one another, then contact is first made between the contact elements 52 and the shielding element 55. Only after the plugs have been pushed further together, then a contact is also formed between the pin contacts 44 and the respective corresponding spring contacts 4. Thus, with such an arrangement it can always be ensured that shielding is provided whenever electrical contact is made between the pin contacts 44 and the spring contacts 4. It should be understood that, according to a further embodiment of the invention, it is also possible to arrange the contact elements 52 on the spring contact block 46 and the shielding elements 55 on the pin contact block 47.

The shielding elements 6, 19, 31, 31' and 38 are advantageously formed having customary sheet metal thicknesses of 0.05 to 0.25 mm, whereby a simple manufacturing of the shielding elements, for example by stamping and forming, is made possible. Furthermore, bending and forming of the shielding elements is easily carried out using common methods and apparatus, for example to fit the elements to a round contact chamber or to particularly formed indentations or recesses in the termination end of a connector plug, as well as to form corrugations or folds of the elements.

It is further provided according to the invention that the shielding elements 6 and 50 may be made of a ferromagnetic material, whereby a magnetic toroidal core is formed around each contact 4 or 44. The toroidal core, interacting with the contacts 4 and 44, induces an inductance as a current flows through the respective contact 4 or 44. Simultaneously, a capacitance arises between the contacts 4 or 44 and the shielding element 6 or 50. By appropriately selecting the type, mass, parameters, etc. of the material, the inductance and capacitance can be varied or adjusted as desired within certain limits. By means of such an inductance and capacitance between the components, the connector plugs according to the invention can form a filter element that suppresses undesirable interference peaks or spikes on the conductor line. Such a filter element is achieved without any additional constructive or structural measures. The connector plug 46, 47 maintains its usual dimensions, which need not be varied, and the overall shielding effect is also maintained. In this manner an increased protection against interference can be achieved, even for many standardized interface connector plugs, for example, plugs used on electronic devices and cables.

The above described filter effect can be increased by a simple circuit modification involving the connector plugs, in that each critical conductor line coming into the connector plug is conducted through several contacts of the connector plug in series. That is to say, the connectors or pin contacts of adjacent contacts are interconnected in series in such a manner that an incoming signal is conducted several times back and forth through the plug connection. Such a serial flow interconnection is indicated schematically in FIG. 6 by the dashed lines 65. By properly arranging and configuring the contacts and configuring the current flow to be in a uniform direction, a magnetic toroidal core is formed around the contact group, which acts like an impedance coil with several windings. Because each contact is nonetheless surrounded by the grounding potential, the capacitance increases linearly. This is especially important for relatively slow information signals with a high interference noise level, which exists, for example, in motor vehicles. It should also be understood that the shielding provided in the connector plugs according to the invention need not be provided throughout the entire connector plug if it is not necessary for the specific technical demands at hand. That is to say, the shielding can be provided only over a portion of the connector plug or only around some of the individual contacts. In this manner, the cost of the connector plug may be reduced to the lowest possible cost.

Although the invention has been described with reference to specific example embodiments, it will be appreciated that it is intended to cover all modifications and equivalents within the scope of the appended claims.

What is claimed is:

1. An electrical connector plug comprising a non-conductive synthetic material block-shaped plug body having at least one contact chamber and at least one slot formed within said plug body, an electrically conducting main contact member arranged in said contact chamber, and an electrically conducting shielding element arranged in said slot to be enclosed by said synthetic material of said plug body, wherein said slot and said shielding element extend substantially around and substantially over the entire length of said main contact member.

2. The electrical connector plug of claim 1, wherein said plug body has a plurality of said contact chambers therein and a plurality of said slots therein, and wherein said connector plug comprises a plurality of said main contact members arranged respectively in said contact chambers, and a plurality of said shielding elements arranged respectively in said slots, and wherein said plurality of shielding elements are conductingly interconnected to form a potential cage.

3. The electrical connector plug of claim 2, further comprising a plurality of main termination pins respectively conductingly connected to said plurality of main contact members, and at least one shielding termination pin conductingly connected to said potential cage, wherein said at least one shielding termination pin has at least about the same configuration as said main termination pins.

4. The electrical connector plug of claim 2, further comprising at least one contact tongue conductingly connecting at least one of said shielding elements to at least one of said main contact members.

5. The electrical connector plug of claim 2, further comprising at least one shielding contact member arranged on a lateral side of said connector plug body and conductingly connected to said potential cage, wherein said shielding contact member of a first one of said electrical connector plugs is arranged to contact said shielding contact member of a second mating one of said electrical connector plugs when said first and second connector plugs are plugged together.

6. The electrical connector plug of claim 5, wherein said shielding contact member of said first one of said electrical connector plugs comprises a spring contact finger arranged to contact said shielding contact member of said second mating one of said electrical connector plugs comprising an exposed shielding element contact when said first and second connector plugs are plugged together.

7. The electrical connector plug of claim 5, wherein said shielding contact member of said second one of said electrical connector plugs comprises a shielding element contact and wherein said lateral side of said connector plug body has at least one slot therein that exposes said shielding element contact, and wherein said shielding element contact is arranged to contact through said slot said shielding contact member of said first mating one of said electrical connector plugs comprising a contact finger when said first and second connector plugs are plugged together.

8. The electrical connector plug of claim 6, wherein said shielding contact member of said first one of said electrical connector plugs further comprises a metal strip connected to said contact finger and shielding termination pins connected to said metal strip, wherein said metal strip extends across said lateral side of said connector plug body.

9. The electrical connector plug of claim 5, wherein said shielding contact member protrudes beyond said main contact members in a plug coupling direction, wherein said shielding contact member of said first one of said electrical connector plugs contacts said shielding contact member of said second mating one of said electrical connector plugs before said main contact members of said first one of said electrical connector plugs contact said main contact members of said second mating one of said electrical connector plugs when said first and second connector plugs are plugged together.

10. The electrical connector plug of claim 2, further comprising a non-conductive synthetic material angled member forming an extension of said plug body, and conductor legs received in and extending through said angled member and conductingly connected to said main contact members, wherein said conductor legs are bent through about 90° as they extend through said angled member.

11. The electrical connector plug of claim 10, wherein said angled member includes two angles of about 45° each, and said conductor legs each comprise two bends of about 45° each.

12. The electrical connector plug of claim 10, wherein said angled member comprises at least two wedge-shaped sections having narrow slots therein and being arranged circumferentially next to each other, and shielding elements arranged in said angled member slots around said conductor legs, wherein said shielding elements are conductingly interconnected to form an extension of said potential cage of said plug body.

13. The electrical connector plug of claim 12, wherein said wedge-shaped sections comprise interlocking members that align and form-lock adjacent ones of said sections together.

14. The electrical connector plug of claim 10, wherein said angled member comprises a plurality of segments arranged radially next to one another, and shielding elements received and held by said segments, wherein one respective row of said conductor legs is received in each of said segments.

15. The electrical connector plug of claim 14, wherein each of said segments comprises at least one bending groove along which each of said segments is bent to form a bend of said angled member.

16. The electrical connector plug of claim 10, further comprising interlocking members that align and form-lock said angled member with said plug body.

17. The electrical connector plug of claim 2 for connecting electrical conductors to a circuit board, wherein at least one of said shielding elements comprises a contact portion arranged to conductingly contact a conductor path of said circuit board.

18. The electrical connector of claim 17, wherein said contact portion comprises a plurality of contact protrusions.

19. The electrical connector plug of claim 17, wherein said contact portion is flexibly yielding.

20. The electrical connector plug of claim 2, further comprising metal plates arranged on lateral sides of said plug body, wherein said metal plates are conductingly connected to said shielding elements.

21. The electrical connector plug of claim 2, wherein said shielding elements comprise a wall thickness from about 0.05 mm to about 0.25 mm.

22. The electrical connector plug of claim 2, wherein at least a portion of said shielding elements comprises a ferromagnetic material.

23. The electrical connector plug of claim 22, wherein said main contact members together with said shielding elements form an electronic filter component.

24. The electrical connector plug of claim 23, wherein several of said main contact members are conductingly interconnected in series so that an electrical signal will be conducted sequentially through said several main contact members.

* * * * *

UNITED STATES PATENT AND TRADEMARK OFFICE

CERTIFICATE OF CORRECTION

PATENT NO. : 5,507,655

DATED : April 16, 1996

INVENTOR(S) : Rudolf Goerlich

It is certified that error appears in the above-identified patent and that said Letters Patent is hereby corrected as shown below:

On the title page, item [56], References Cited, add:
"IBM Technical Disclosure Bulletin, Vol. 21, No.3, Aug. 1978 pages 955, 956";

Column 5, line 42, after "termination" insert --pins--;
line 43, after "proper" insert --configuration even after the legs 15 are bent through two 45°--;
line 44, after "termination" insert --pins--;
line 55, after "termination" insert --pins--;

Column 6, line 48, after "terminations" insert --41--.

Signed and Sealed this

Sixteenth Day of July, 1996

Bruce Lehman

*Attest:*

BRUCE LEHMAN

*Attesting Officer*

*Commissioner of Patents and Trademarks*